US008188410B2

(12) United States Patent
Dean et al.

(10) Patent No.: US 8,188,410 B2
(45) Date of Patent: May 29, 2012

(54) PORTABLE PARTY TABLE

(76) Inventors: Marlene Dean, South Gibson, PA (US); Larry Dean, South Gibson, PA (US)

( * ) Notice: Subject to any disclaimer, the term of this patent is extended or adjusted under 35 U.S.C. 154(b) by 683 days.

(21) Appl. No.: 12/263,842

(22) Filed: Nov. 3, 2008

(65) Prior Publication Data

US 2009/0056595 A1 Mar. 5, 2009

Related U.S. Application Data

(63) Continuation-in-part of application No. 11/364,948, filed on Mar. 1, 2006, now abandoned.

(51) Int. Cl.
*H05B 3/68* (2006.01)
*A47F 5/12* (2006.01)

(52) U.S. Cl. ..... 219/452.13; 219/452.12; 219/452.11; 108/25; 108/32; 108/34; 108/35; 108/50.13; 108/50.02; 108/115; 108/129; 108/167; 108/169; 312/204; 312/223.5

(58) Field of Classification Search ..... 108/24, 108/25, 32, 34, 35, 50.02, 50.13, 115, 129, 108/167, 169, 173–4; 312/204, 223.5; 219/452.13, 219/452.12, 452.11
See application file for complete search history.

(56) References Cited

U.S. PATENT DOCUMENTS

| | | | | |
|---|---|---|---|---|
| 2,167,742 | A * | 8/1939 | Borio | 312/204 |
| 2,709,631 | A * | 5/1955 | Covucci | 108/36 |
| 4,341,164 | A * | 7/1982 | Johnson | 108/67 |
| 2005/0109245 | A1 * | 5/2005 | Pote | 108/25 |

* cited by examiner

*Primary Examiner* — Shawntina Fuqua
(74) *Attorney, Agent, or Firm* — Charles L. Riddle, Esq; Riddle Patent Law, LLC

(57) ABSTRACT

A portable party table [1000] for holding hot and cold foods is described. It employs at least two sections [1100, 1500] held together with a hinge [1600] for holding foods. The party table [1000] has folding legs [1111, 1511] and leg supports [1113, 1513] to support the legs. Each section [1100, 1500] has a tapered base [1101, 1501] with a drain hole [1107, 1507] and a drain plug [1109, 1509]. As ice melts it is directed toward the drain holes [1107, 1507]. Electric receptacle [1525] provide electricity for a heating plate. Alternatively, the hinge [1600] is a type which provides spacing between the sections [1100, 1500] to thermally insulate the hot from the cold section. The hinge [1600] may be allowed to slide to provide an insulation gap [1607], or eliminate the gap [1607].

10 Claims, 7 Drawing Sheets

PORTABLE PARTY TABLE

CROSS REFERENCE TO RELATED APPLICATIONS

This application is a Continuation-In-Part of U.S. Provisional patent application Ser. No. 11/364,948 "PORTABLE HOT AND COLD PARTY TABLE" filed Mar. 1, 2006 now abandoned by the same inventor as the present application, Larry Dean and Marlene Dean. The present application claims priority from this application and incorporates all material as if it were set forth in its entirety herein.

FEDERAL SPONSORED RESEARCH

Not Applicable

SEQUENCE LISTING OR PROGRAM

Not Applicable

BACKGROUND OF THE INVENTION

1. Field of the Invention

The present invention relates to a portable table which opens into a buffet for holding hot and cold foods.

2. Discussion of Related Art

People have celebrations from time to time, many of which include a dinner. It is also common to have a buffet-style dinner at these events in which the guests help themselves to the food.

The foods may be required to be cooled or warmed, depending upon the foods offered.

There are buffet tables, or party tables which are designed to hold ice upon which containers of the food are placed.

There are also buffet tables which have gas burners, electric burners to keep the food warm.

Usually the buffets are all hot or cold buffets for thermal efficiency.

It is not common for a person to incur the expense of buying a hot and/or cold buffet table unless they have many such celebrations.

Also, these celebrations may be at different locations.

Therefore, it makes sense to have a portable buffet which may be borrowed, transported to the celebrations and returned.

The full buffets are too large and bulky to transport. Also, both a hot and cold buffet table would be required for hot and cold food.

Currently, there is a need for a portable buffet which efficiently holds both hot and cold foods.

SUMMARY OF THE INVENTION

The present invention may be embodied as A portable party table for holding food, comprising:

a) a first section [1100] having a tapered base [1101] with a drain hole [1107] allowing liquids to run toward the drain hole [1107], b) a second section [1500] having a tapered base [1501] with a drain hole [1507] allowing liquids to run toward the drain hole [1507], c) a hinge [1600] connected to the first section [1100] and the second section [1500] allowing the first section [1100] to pivot flat against the second section [1500], or to pivot outward to a full extended position in which the sections are coplanar, d) a first set of folding legs [1111] within the first section [1100] capable of being in a folded position, folding into the first section or in an extended position holding the first section [1100] in an upright position, and e) a second set of folding legs [1511] within the second section [1500] capable of being in a folded position, folding into the second section [1500], or in an extended position holding the second section [1500] in an upright position alongside of the first section [1100] for holding food as a buffet.

The present invention may also be embodied as

OBJECTS OF THE INVENTION

It is an object of the present invention to provide a portable buffet for both hot and cold foods.

It is another object of the present invention to provide a portable buffet which is easy to transport.

It is another object of the present invention to provide a portable buffet which folds into a compact unit.

It is another object of the present invention to provide a portable buffet which limits the transfer of heat from the hot foods to the cold foods.

BRIEF DESCRIPTION OF THE DRAWINGS

The advantages of the instant disclosure will become more apparent when read with the specification and the drawings, wherein.

DETAILED DESCRIPTION OF THE INVENTION

At a party some of the foods must be kept chilled. One easy way is to have the food placed on ice cubes. The ice cubes take some time to melt. They can keep foods cold for several hours.

Other foods require heating. One such way to heat the food is to provide an electric hot plate. This requires a source of electric power.

Another method of heating would be the use of prepackaged flammable canisters. Therefore, the structure should be provided to hold these in a safe and secure location for an extended period of time while they are burning.

A structure to hold both the ice and chilled food and the heating means and hot food should be provided. In its preferred embodiment, it incorporates the structure to insulate the hot section from the cold section and to improve the efficiency of both.

Figure 1:
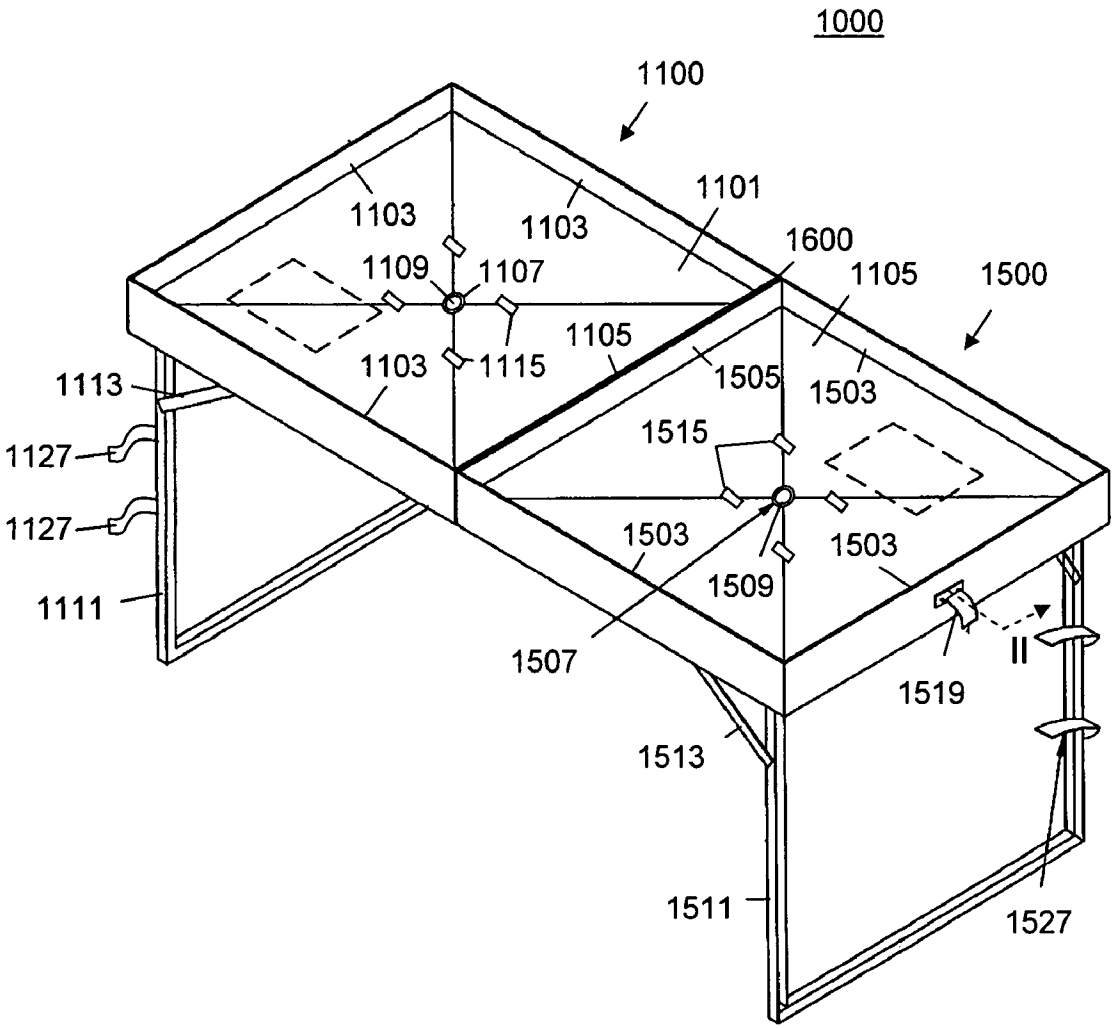
FIG. 1 is a perspective view of one embodiment of the portable party table 1000 according to the present invention.

FIG. 1 is a perspective view of one embodiment of the portable buffet 1000 according to the present invention.

Here it can bee seen that the portable party table 1000 is shown in its open and operational position. This embodiment has a first section 1100 and a second section 1500. First section 1100 has a lip 1103, which is typically a few inches high that surrounds the upper side of the first section 1100.

A second section 1500 has a lip 1503, which is also a few inches high that surrounds its upper side.

These lips 1103, 1503 are designed to hold ice if the section is intended to be used to hold chilled foods.

First section 1100 has a tapered base 1101 which angles from the lip 1103 downward toward a drain hole 1107 plugged with a drain plug 1109. In this embodiment it is shown in the center, but may be at various locations on tapered base 1101.

Similarly, second section 1500 has a tapered base 1501 which angles from the lip 1503 downward toward a drain hole 1507 plugged with a drain plug 1509. Again, this drain hole 1507 and drain plug 1509 may be at various locations on tapered base 1501.

The first section 1100 and the second section 1500 are attached at a hinge 1600.

The first section 1100 is held up with folding legs 1111 shown in their extended position. A pair of leg supports 1113 hold and lock the folding legs 1111 in their extended position so that the folding legs 1111 stay extended.

Similarly, the second section 1500 is held up with folding legs 1511 shown in their extended position. A pair of leg supports 1513 hold and lock the folding legs 1511 in their extended position so that the folding legs 1511 stay extended.

Each tapered base 1101, 1501 preferably includes attachment points 1115, 1515, respectively such as slots for attaching a structure to hold heating canisters in place when used for heating foods.

If one side will be used to chill food and the other to heat food, it is important to have thermal insulation between the sides. Preferably center lip 1105 and 1505 are made of a thermally insulating material to slow heat conduction from first section 1100 to second section 1500.

Alternatively, center lips 1105, 1505 may be made hollow and/or contain thermal insulating material.

A first connector extends from an outer side of the first section 1100 (not shown here). Similarly, a second connector 1519 extends from an outer side of the second section 1500. These are positioned such that when the portable party table 1000 is folded first connector meets with and attaches to second connector 1519. In this embodiment, second connector 1519 is a strap with a hook and loop connector, commonly sold under the name of Velcro®. The other connector (not shown here) is a metal loop through which the strap passes and then secures to itself.

Leg retainers 1127, 1527 holds folding legs 1111, 1511 in their folded position. Leg retainer 1127, 1527 may be a common attachment means, such as hook and loop connector sold under the name Velcro®.

Figure 2:
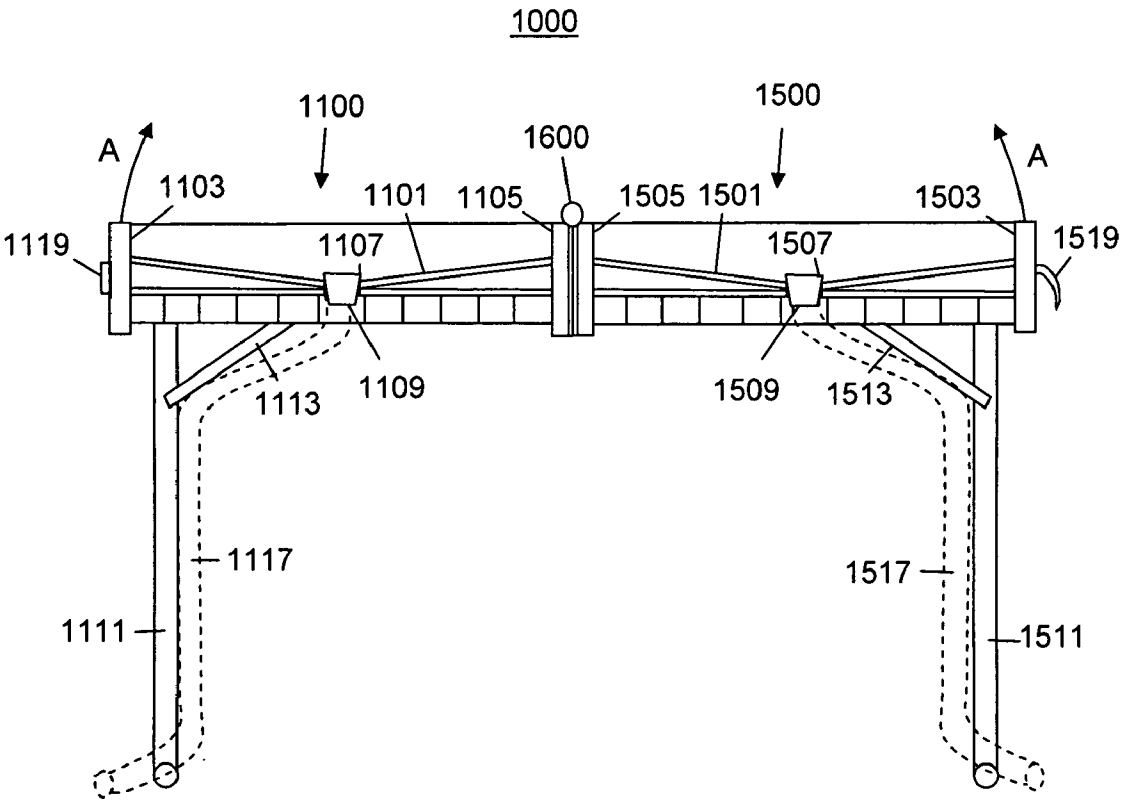
FIG. 2 is a sectional side elevational view of the portable party table 1000 of FIG. 1.

FIG. 2 is a sectional side elevational view of the portable party table 1000 of FIG. 1. Here the first section 1100 and second section 1500 are shown connected by a hinge 1600 on the upper side of center lips 1105, 1505.

Tapered base 1101 of the first section 1100 is shown tapering from the lip 1103 downward to the drain hole 1107. This allows water from the melting ice in first section 1100 to move downward toward the drain hole 1107.

Second section 1500 has a similar structure and function.

Either or both sections 1100, 1500 may optionally employ a drainage tube 1117, 1517 which attaches to the drain holes 1107, 1507. This allows liquids to be drained away from the portable party table 1000.

After use, first section 1100 and second section 1500 are folded toward each other in the direction of the arrow marked "A" to fold flat against each other. First connector 1119 connects to second connector 1519 holding first section 1100 to second section 1500.

Folding legs 1111 fold into the bottom of the first section 1100 and folding legs 1511 fold into the bottom of the second section 1500.

Figure 3:
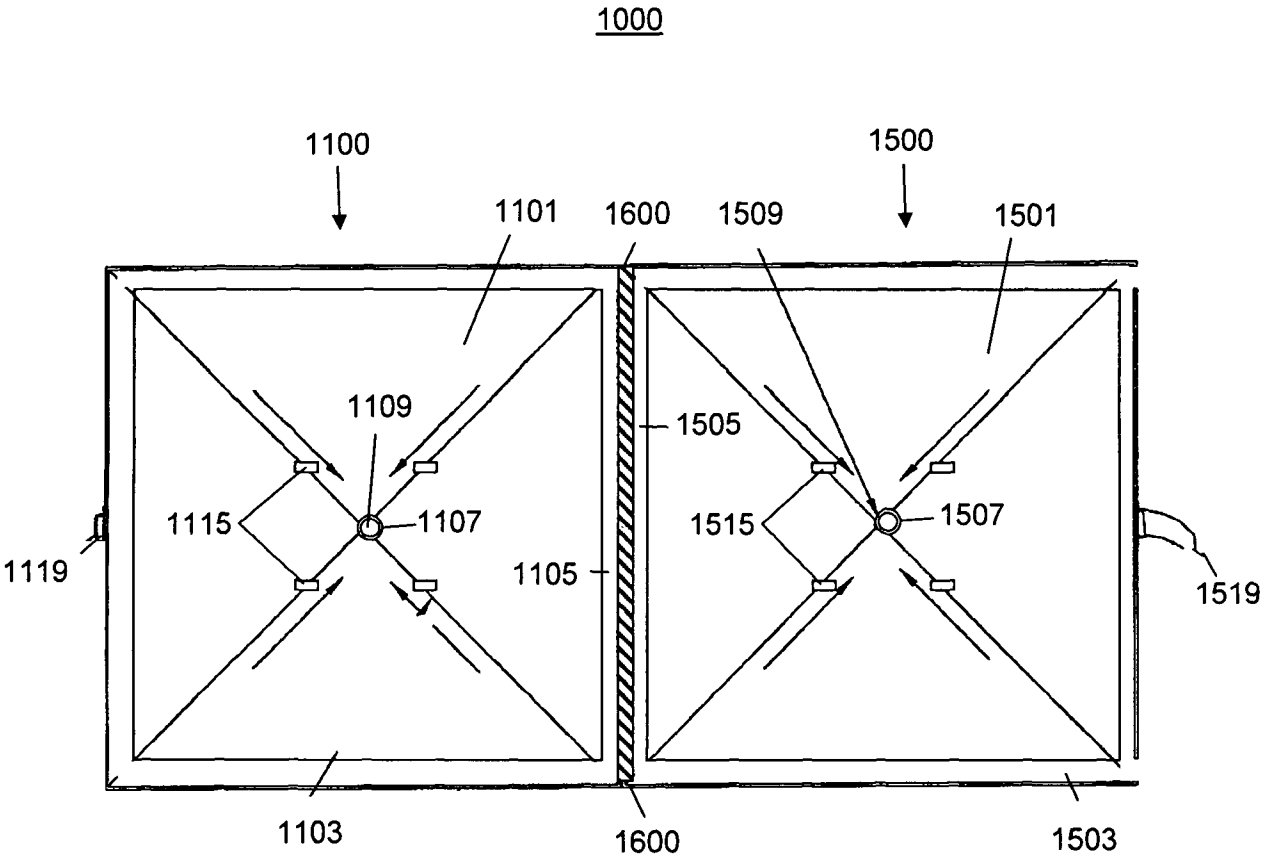
FIG. 3 is a plan view of the portable party table 1000 of FIGS. 1 and 2 as viewed from the top.

FIG. 3 is a plan view of the portable party table 1000 of FIGS. 1 and 2 as viewed from the top. The tapered base 1101 and lip 1103 of first section 1100 are visible from this view, as is the drain hole 1107.

The tapered base 1501 and lip 1503 of second section 1500 are also visible. Drain hole 1507 is shown at its center.

Center lip 1105 and 1505 are shown here adjacent to each other.

First connector 1119 and second connector 1519 are also visible.

Figure 4:
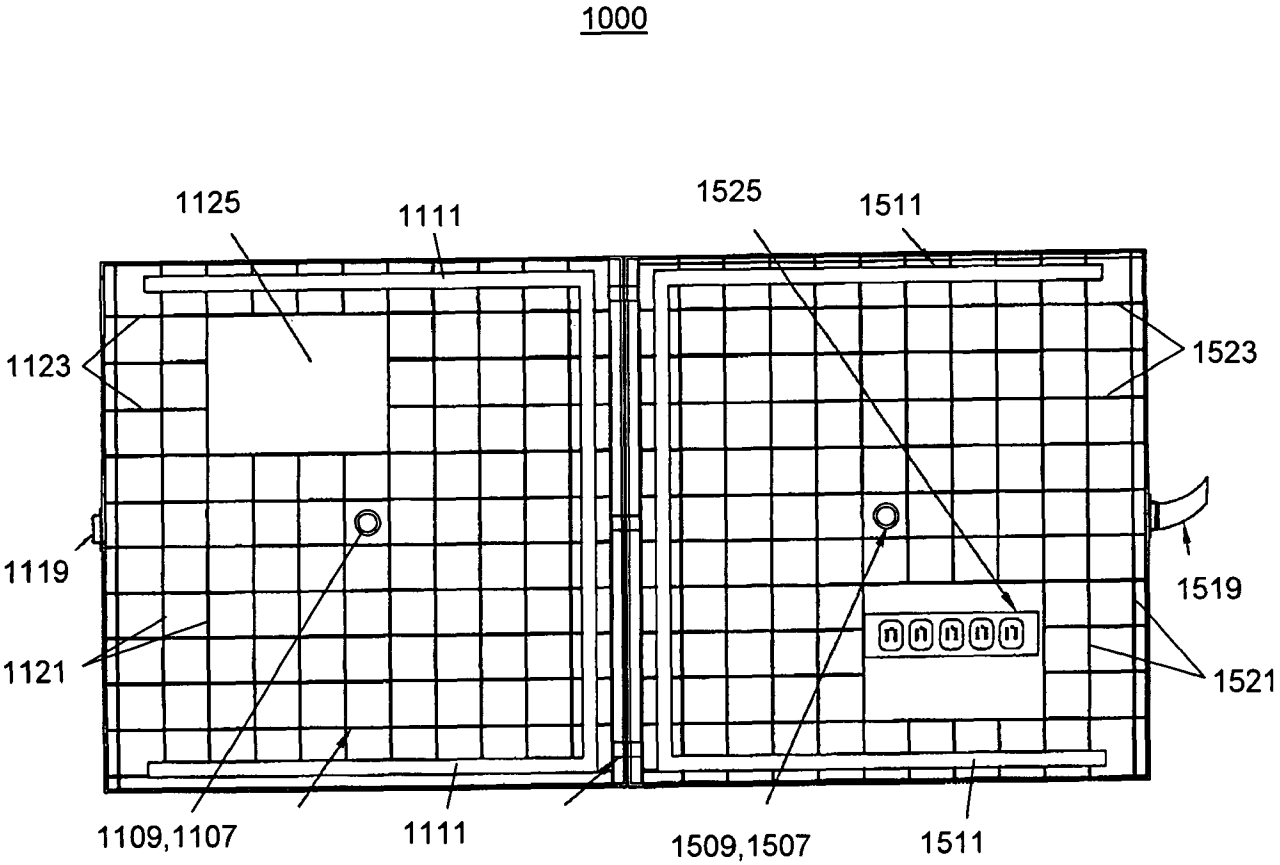
FIG. 4 is a plan view of the portable party table 1000 of FIGS. 1, 2 and 3 as viewed from the bottom.

FIG. 4 is a plan view of the portable party table 1000 of FIGS. 1, 2 and 3 as viewed from the bottom. As before, drain holes 1107, 1507 and drain plugs 1109, 1509 are visible. Also, connectors 1519 and 1119 are also visible. Folding legs 1111, 1511 are shown in their folded position. For strength, vertical ribs 1121, 1521 and horizontal ribs 1123, 1523 may be employed.

Since electricity will be required for electric hotplates, an electrical receptacle 1525 may be employed. There also may be protrusions from the bottom of the party table for wrapping, holding and storing the electric cord extending from the electric receptacle 1525.

There is a receptacle space 1125 which there are no horizontal or vertical ribs, providing a location to attach another electric receptacle if required.

The drain plug 1509 may be unplugged to allow any wires from a heat source to pass through drain hole 1507 and to receptacle 1525. In an alternative embodiment, there may be other holes serving the same purpose.

Figure 5:
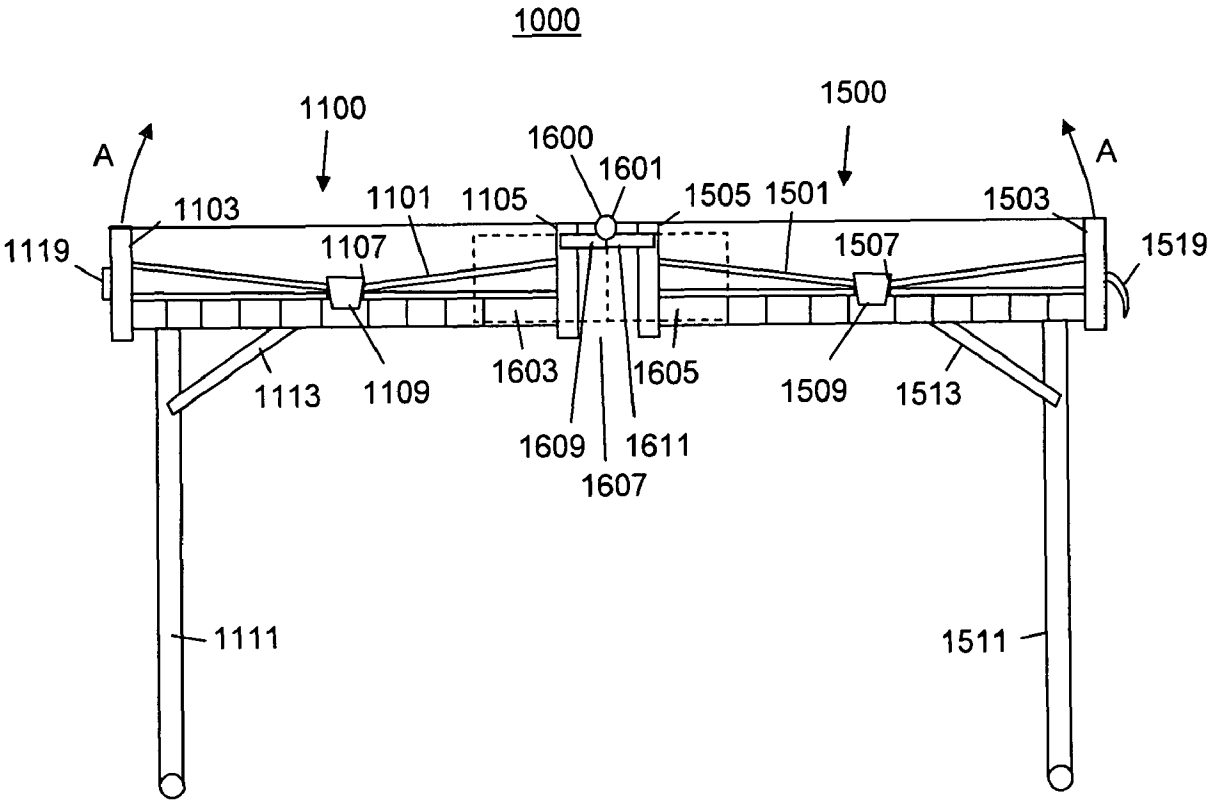
FIG. 5 is a sectional side elevational view of another embodiment of the portable party table 1000 according to the present invention.

FIG. 5 is a sectional side elevational view of another embodiment of the portable party table 1000 according to the present invention. In this embodiment, the hinge 1600 is extended to create a gap 1607 between sections 1100 and 1500. This reduces the transmission of heat between the sections and makes it more efficient when using one section for hot foods and the other for cold foods.

Figure 6:
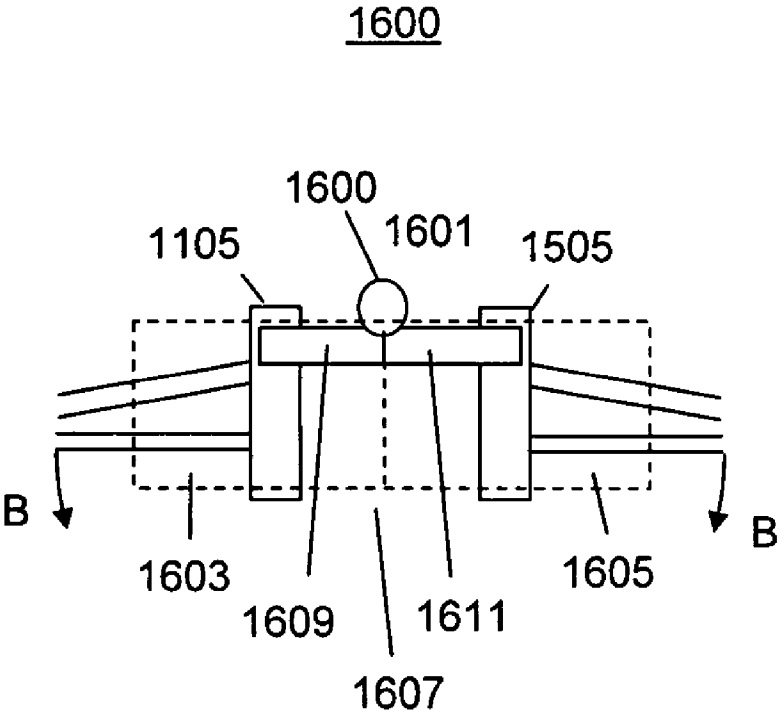
FIG. 6 is a partial enlarged view of the hinge 1600 of FIG. 5.

FIG. 6 is a partial enlarged view of the hinge 1600 of FIG. 5. Hinge connectors 1609 and 1611 rotate about hinge pivot 1601. Hinge connection 1609 extends into and is connected to center lip 1105 of section 1100, preferably along the length of center lip 1105.

Hinge 1600 also has a hinge connector 1611 that extends into and is connected to center lip 1505, preferably for the length of lip 1505.

Hinge 1600 pivots about hinge pivot 1601. In this figure, hinge 1600 is shown in its full opened position. Since it can rotate no further in the direction marked "B", it supports the center of party table 1000 where section 1100 meets section 1500. By its design, it creates a gap 1607 used to separate and thermally insulate section 1100 from section 1500.

For additional support, end plates may be employed within the lips at the edges of hinge 1600.

Figure 7:
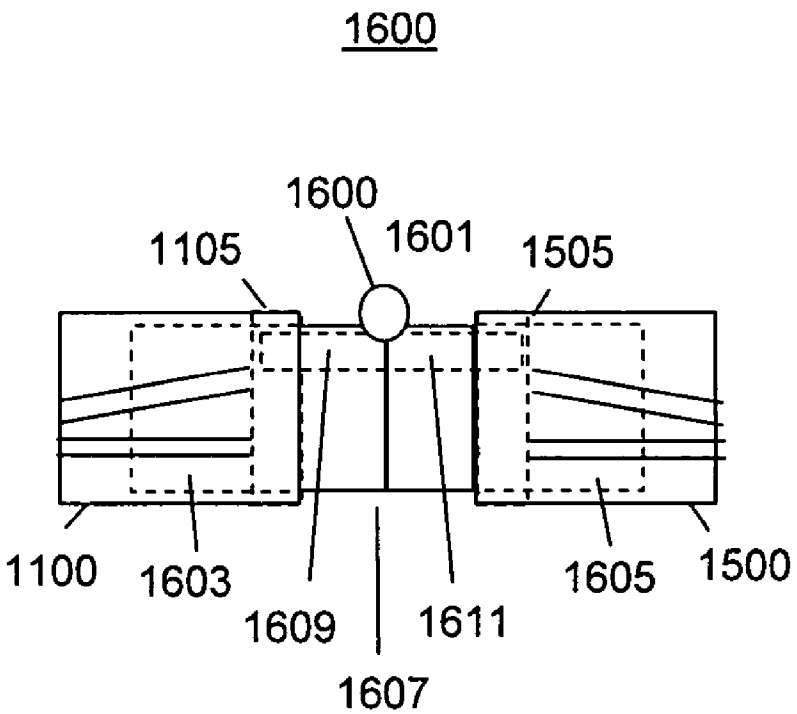
FIG. 7 is a sectional side elevational view of the hinge of FIG. 5.

FIG. 7 is a sectional side elevational view of the hinge of FIG. 5 as viewed from a side of party table 1000. Here the sides of sections 1100 and 1500 may be seen. A plate 1603 is secured within and partially extends from a sidewall of section 1100. Plate 1603 is pivotally attached to hinge pivot 1601. Similarly, a plate 1605 is secured within and partially extends from a sidewall of section 1500. Plate 1605 is pivotally attached to hinge pivot 1601. Plates 1603 and 1605 provide additional support to hinge 1600 and party table 1000.

In a further alternative embodiment, plates 1605 and 1603 may be allowed to slide out of section 1100 and 1500 until they hit a stop. This allows sections 1100 and 1500 to remain in intimate contact, or to create spaces by a gap allowing for thermal insulation between them.

In another embodiment of the present invention, the gap 1607 of FIGS. 5-7 may be filled with a thermal insulation material to further thermally insulate the sections.

Figure 8:
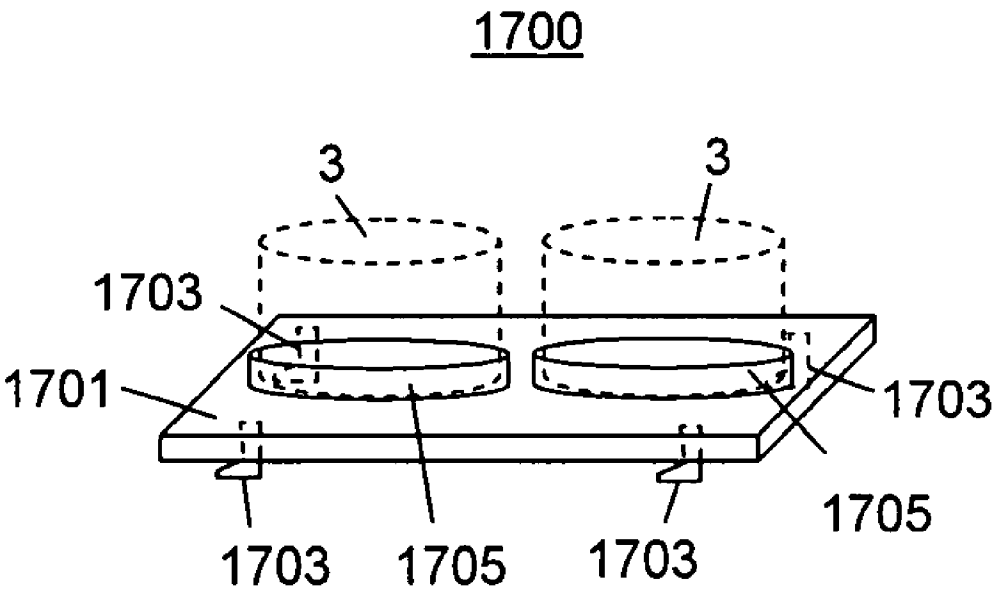
FIG. 8 is a perspective view of one embodiment of a canned fuel support.

FIG. 8 is a perspective view of one embodiment of a heater support 1700 for securely holding a heating source for warming food. In this embodiment it is shown as fuel canisters 3. Heater support 1700 may also hold and support an electric heating plate or other heating source. It is only required when hot foods are being served. It is not used when cold foods are being served.

Heater support 1700 includes a support base 1701 which has a plurality of connector feet 1703. These connector feet are intended to fit in the attachment points (1115 and 1515 of FIGS. 1 and 3).

Support base 1701 has ridges 1705 which are sized to receive fuel canisters 3. Heater support 1700 has holds the fuel canisters 3 as they burn keeping the food hot. Heating support 1700 keeps the heat source 3 off of the tapered base 1101, 1501. This prevents the tapered base 1101, 1501 from melting if it is constructed from a plastic material.

Heater support 1700 also acts as a safety device by preventing the fuel canisters 3 from tipping and starting a fire.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A portable party table [1000] for holding food, comprising:

a) a first section [1100] having a tapered base [1101] with a drain hole [1107] allowing liquids to run toward the drain hole [1107], b) a second section [1500] having a tapered base [1501] with a drain hole [1507] allowing liquids to run toward the drain hole [1507], c) a hinge [1600] connected to the first section [1100] and the second section [1500] allowing the first section [1100] to pivot flat against the second section [1500], or to pivot outward to a full extended position in which the sections are coplanar, d) a first set of folding legs [1111] within the first section [1100] capable of being in a folded position, folding into the first section [1100], or in an extended position holding the first section [1100] in an upright position, and e) a second set of folding legs [1511] within the second section [1500] capable of being in a folded position, folding into the second section [1500], or in an extended position holding the second section [1500] in an upright position alongside of the first section [1100] for holding food as a buffet;

f) wherein either i) at least one of the first section [1100] or the second section [1500] employs horizontal ribs [1523] and/or vertical ribs [1521] for increasing the structural support of the party table [1000] and/or ii) at least one of the first section [1100] or the second section [1500] employs an electrical receptacle [1525] for providing electricity to devices to heat said food.

2. The portable party table [1000] of claim 1 further comprising:

a heater support [1700] for attaching to the tapered base [1101,1501] for supporting a heat source [3] and preventing the heat source from tipping and damaging the tapered base [1101,1501].

3. The portable party table [1000] of claim 1 wherein the first section [1100] further comprises a first connector [1119] and the second section [1500] further comprises a second connector [1519] which is designed to interact with the first connector [1119] holding the first section [1100] to the second section [1500] when the sections [1100,1500] are folded flat against each other.

4. The portable party table [1000] of claim 1 further comprising:

at least one leg retainer [1127,1527] for holding folding legs [1111,1511] in the folded position.

5. A portable party table [1000] for holding food, comprising:

a) a first section [1100] having a tapered base [1101] with a drain hole [1107] allowing liquids to run toward the drain hole [1107], b) a second section [1500] having a tapered base [1501] with a drain hole [1507] allowing liquids to run toward the drain hole [1507], c) a hinge [1600] connected to the first section [1100] and the second section [1500] allowing the first section [1100] to pivot flat against the second section [1500], or to pivot outward to a full extended position in which the sections are coplanar, d) a first set of folding legs [1111] within the first section [1100] capable of being in a folded position, folding into the first section [1100], or in an extended position holding the first section [1100] in an upright position, e) a second set of folding legs [1511] within the second section [1500] capable of being in a folded position, folding into the second section [1500], or in an extended position holding the second section [1500] in an upright position alongside of the first section [1100] for holding food as a buffet, and f) a heater support [1700] for attaching to the tapered base [1101,1501] for supporting a heat source [3] and preventing the heat source from tipping and damaging the tapered base [1101,1501].

6. The portable party table [1000] of claim 5 wherein the tapered base [1101,1501] includes attachment points [1115, 1515], and the heater support [1700] further comprises connector feet [1703] which connect to the attachment points [1115, 1515] to secure the heater support [1700] to the tapered base [1101,1501].

7. A portable party table [1000] capable of folding into a compact form and opening into a table adapted to hold and chill cold foods and heat warm foods, comprising:

a) a first section [1100] having a tapered base [1101] tapering toward a drain hole [1107] adapted for holding ice and allowing water from the ice as it melts to run toward the drain hole [1107];

b) a second section [1500] having a base [1501] for holding hot food;

c) a hinge [1600] having:

i. a first hinge connection [1609] connected between a hinge pivot [1601] and the first section [1100], and ii. a second hinge connection connected between a hinge pivot [1601] and the second section [1500], the hinge [1600] functioning to allow the first section [1100] to fold flat against the second section [1500] in one position and allowing the first section [1100] to lay in a coplanar position adjacent the second section [1500] when the hinge is in its fully extended position, the hinge [1600] designed to cause a gap [1607] to be created between the first section [1100] and the second section [1500] to reduce the flow of heat between the sections [1100,1500];

d) wherein i) at least one of the first section [1100] or the second section [1500] employs horizontal ribs [1523] and/or vertical ribs [1521] for increasing the structural support of the party table [1000], and/or ii) the portable party table [1000] further comprises a heater support [1700] for attaching to the tapered base [1101,1501] for supporting source [3] and preventing the heat source from tipping and damaging the tapered base [1101,1501].

8. The portable party table [1000] of claim 7 wherein at least one of the first section [1100] or the second section [1500] employs a plug [1109, 1509] in the drain hole [1107, 1507] for stopping the flow of liquids.

9. The portable party table [1000] of claim 7 wherein at least one of the first section [1100] or the second section [1500] employs a drainage tube [1117,1517] connected to the drain hole [1107,1507] for directing the flow of liquids.

10. The portable party table [1000] of claim 7 wherein at least one of the first section [1100] or the second section [1500] employs an electrical receptacle [1525] for providing electricity to devices to heat said food.

* * * * *